US006530414B2

(12) United States Patent
Mayr et al.

(10) Patent No.: US 6,530,414 B2
(45) Date of Patent: Mar. 11, 2003

(54) INSULATING GLASS PANE COMPRISING AN INTEGRATED ROLLER BLIND DEVICE

(76) Inventors: Michael Mayr, Hofmarkstrasse 26, 89435 Finningen (DE); Franz Lutz, Diemantstein 92, 86657 Bissingen (DE)

( * ) Notice: Subject to any disclaimer, the term of this patent is extended or adjusted under 35 U.S.C. 154(b) by 0 days.

(21) Appl. No.: 09/954,498

(22) Filed: Sep. 17, 2001

(65) Prior Publication Data

US 2002/0053410 A1 May 9, 2002

Related U.S. Application Data

(63) Continuation-in-part of application No. PCT/EP01/00586, filed on Jan. 19, 2000.

(30) Foreign Application Priority Data

Jan. 20, 2000 (DE) ..... 100 02 357
Aug. 24, 2000 (DE) ..... 100 41 540

(51) Int. Cl.[7] ..... A47H 1/00
(52) U.S. Cl. ..... 160/98; 160/310
(58) Field of Search ..... 160/98, 310, 265, 160/322, 84.02, 107, 133

(56) References Cited

U.S. PATENT DOCUMENTS 1,828,623 A * 10/1931 Sacerdote ..... 160/98
2,530,218 A * 11/1950 Barrows ..... 160/98
4,503,900 A * 3/1985 Osaka et al. ..... 160/107
4,766,941 A * 8/1988 Sloop et al. ..... 160/310 X
4,815,515 A * 3/1989 Lee ..... 160/310 X
5,540,269 A * 7/1996 Plumer ..... 160/310 X
5,810,065 A * 9/1998 Solari ..... 160/310
6,086,133 A * 7/2000 Alonso ..... 160/265 X
6,095,231 A * 8/2000 Hahn ..... 160/265 X

FOREIGN PATENT DOCUMENTS

EP 0 483 528 5/1992

* cited by examiner

*Primary Examiner*—David M. Purol
(74) *Attorney, Agent, or Firm*—Klaus & Bach

(57) ABSTRACT

In an insulating glass window comprising two spaced glass panels which are sealingly joined at their circumference to form a sealed space in which a roller blind device is enclosed, the roller blind device includes a windup drum with a blind wound thereon and having a free end connected to a pull rod, and pull members are arranged at opposite ends of the drum and the pull rod is connected to the pull members. The pull members are operatively connected to a shaft on which the windup drum is rotatably supported for synchronous movement of the pull members and an electric motor is provided for rotating the shaft and the pull members, the windup drum being rotationally connected to the shaft by way of a rotational torsion spring structure.

15 Claims, 3 Drawing Sheets

INSULATING GLASS PANE COMPRISING AN INTEGRATED ROLLER BLIND DEVICE

This is a Continuation-In-Part application of international application PCT/EP01/00586 filed Jan. 19, 2000 and claiming the priority of German applications 100 02 357.6 filed Jan. 20, 2000 and 100 41 540.7 filed Aug. 24, 2000.

BACKGROUND OF THE INVENTION

The invention relates to an insulating glass pane which comprises two spaced glass panels, which form therebetween a hermetically closed space in which a roller blind device is accommodated.

EP 0 154 218 A2 discloses an insulating glass pane with an integrated roller blind device. In this design, the space between the two individual glass panels is in communication, at the upper end of the glass panels, with a housing in which a blind winding drum with an electrical drive is disposed. The housing is hermetically sealed with the space between the two individual glass panels. The blind extends from the drum into the space between the glass panels.

The housing which accommodates the blind winding drum with the drum drive has a substantially greater thickness than the insulating glass pane so that it extends substantially over the edges of the insulating glass pane. This known insulating pane structure can therefore be used only where the frame of the insulating glass pane is provided with special means for accommodating the roller blind housing.

It is the object of the present invention to provide an insulating glass pane with an integrated roller blind device which can be installed in any conventional window frame and which can also be installed in window frames as replacement for common insulating glass panes.

SUMMARY OF THE INVENTION

In an insulating glass window comprising two spaced glass panels which are sealingly joined at their circumference to form a sealed space, in which a roller blind device is enclosed, the roller blind device includes a windup drum with a blind wound thereon and having a free end connected to a pull rod and pull members are arranged at opposite ends of the drum and the pull rod is connected to the pull members. The pull members are operatively connected to a shaft on which the wind-up drum is rotatably supported for synchronous movement of the pull members and an electric rotor is provided for rotating the shaft and the pull members, the windup drums being rotationally connected to the shaft by a rotational torsion spring structure.

Below two embodiments of the invention will be described in greater detail on the basis of the accompanying drawings.

DESCRIPTION OF PREFERRED EMBODIMENTS

Figure 1:
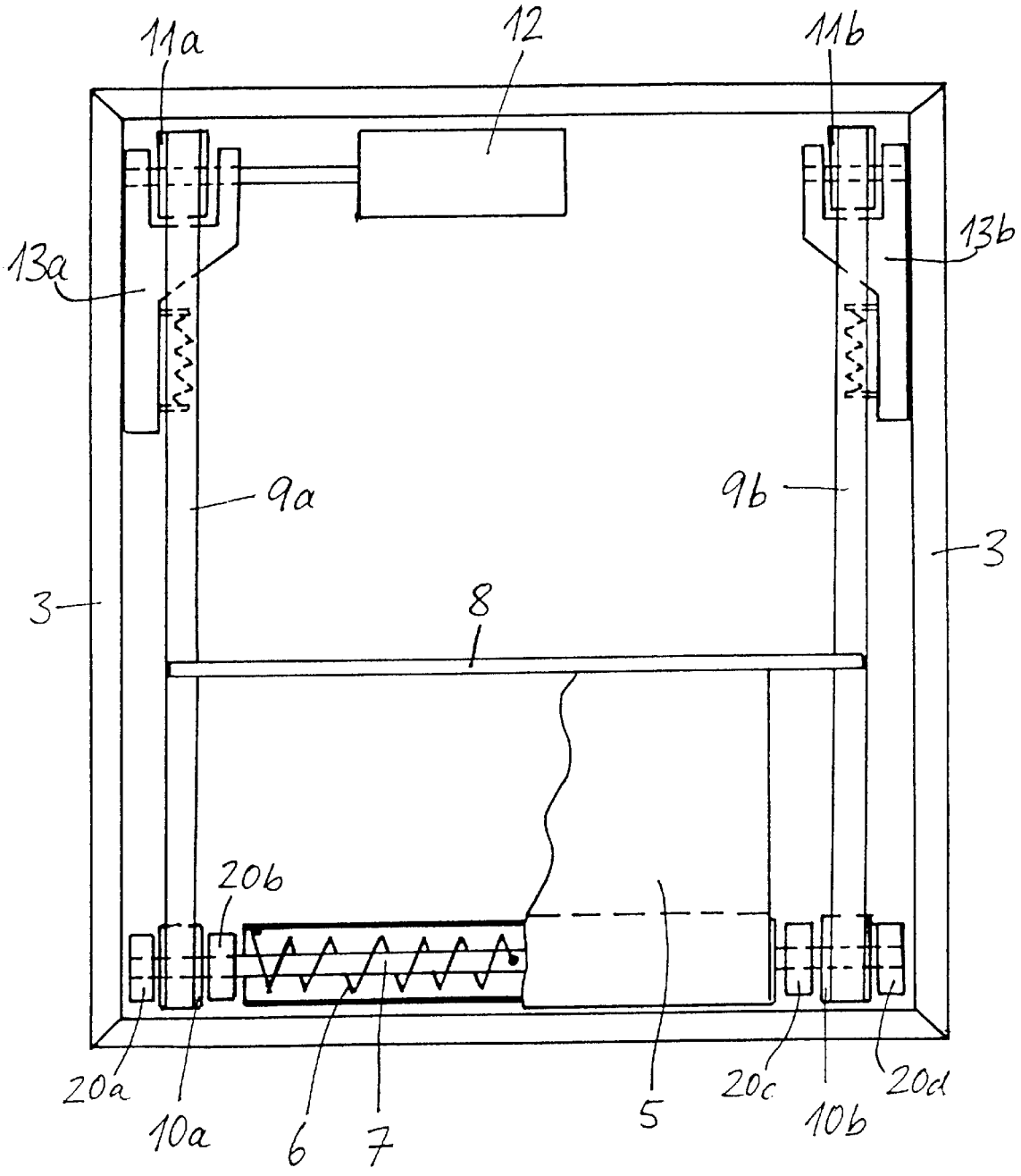
FIG. 1 is a front view of an insulating glass pane with an integrated roller blind device.

The arrangements as shown in the drawings each include two glass panels 1, 2, which may be arranged at a distance of 16 mm from each other as it is common presently for insulated glass panes. The roller blind device described below is disposed between the glass panels. The glass panels are joined with an aluminum web disposed circumferentially therebetween such that the space between the glass panels is closed in a diffusion-tight manner. No cleaning or servicing is needed and the pane can be installed in window frames without problems. The roller blind device arranged in the space between the two glass panels may serve as a sun protector or it may provide for complete darkening.

Figure 2:
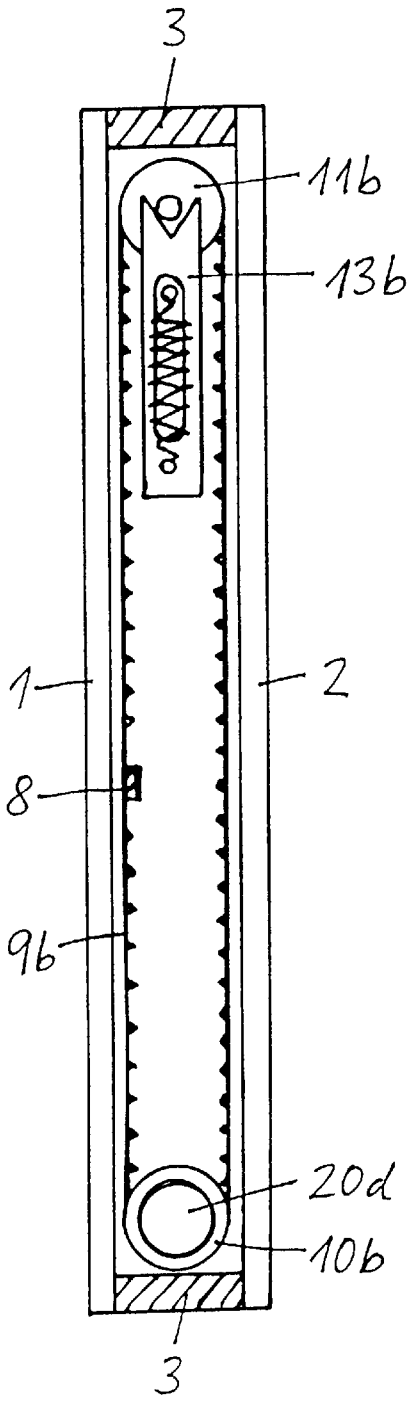
FIG. 2 is a cross-sectional side view of the arrangement shown in FIG. 1.
Figure 3:
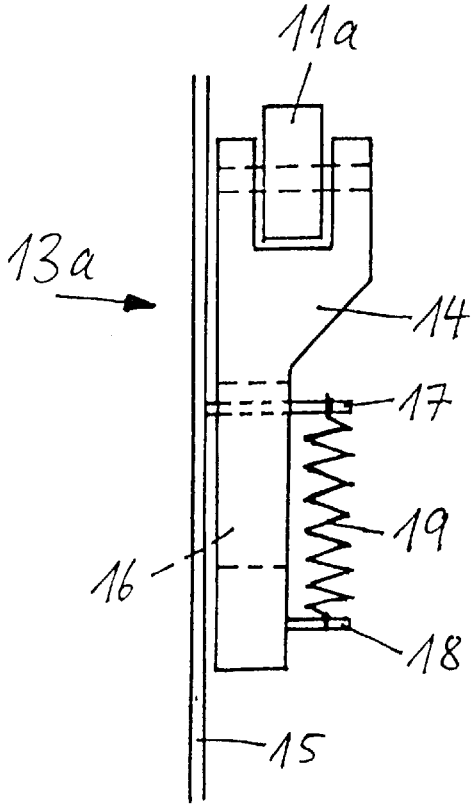
FIG. 3 shows a detail of the arrangement shown in FIGS. 1 and 2.

The embodiment of the roller blind device disposed between the glass panels 1, 2 as shown in the embodiment of FIGS. 1 to 3 includes a winding tube 4 onto which the blind 5 (foil) is cemented and wound. The winding tube 4 forms a wind-up drum and is supported on a shaft 7 by way of a pre-tensioned torsion spring 6.

At the free end of the blind 5, a pull rod 8 is attached to the blind 5. At its opposite ends, the pull rod 8 is connected to toothed pelts 9*a*, 9*b*. The toothed belts 9*a*, 9*b* extend each over a toothed belt pulley 10*a* and, respectively, 10*b*, which are mounted on the shaft 7 of the drum 4, which extends over the full window width. In addition, the toothed belt 9*a* extends over a toothed belt guide pulley 11*a*, which can be driven by an electric motor 12. The other toothed belt 9*b* extends similarly over another toothed belt guide pulley 11*b*. The toothed belt pulley 11*a* as well as the toothed belt pulley 11*b* are supported each in a tensioning unit 13*a*, 13*b*, so that the toothed belts 9*a* and 9*b* are always under tension for slip-free operation. One of the two tensioning units, that is, the tensioning unit 13*a* is shown in FIG. 3 in detail.

The toothed belt 9*a* is driven by the toothed belt pulley 11*a*, which is operated by the motor 12 and which drives the toothed belt pulley 10*a* on one end of the shaft 7. The toothed belt 9*b* is driven by the toothed belt pulley 10*b*, which is disposed at the other end of the shaft 7. The toothed belt 9*b* drives the toothed belt pulley 11*b*.

Since the pull rod 8 is connected to the toothed belts 9*a* and 9*b*, it is moved upwardly or downwardly depending on the direction of rotation of the motor 12.

In the one tensioning unit 13*a* shown in FIG. 3 in detail, the toothed belt pulley 11*a* is supported by a molded plastic member 14. The molded plastic member 14 is slidably supported on a support member 15. It has an elongated opening 16 through which a pin 17 extends, which is mounted to the support member 15. A tension spring 19 extends between the pin 17 and another pin 18, which is mounted to the lower end of the molded plastic member 15. The tension spring 19 biases the molded plastic part 14 and, together therewith, the toothed belt pulley 11*a* upwardly relative to the support member 15 for tensioning the toothed belt 9*a*.

Of particular importance is the arrangement of the winding drum 4 on the shaft 7. The shaft 7 is rotatably supported by ball bearings 20*a*, 20*b*, 20*c* and 20*d* as shown in FIG. 1. The drum 4 is rotatably supported on the shaft 7 and, as already mentioned, is connected to the shaft 7 by way of the torsion spring 6. The two toothed belt pulleys 10*a* and 10*b* are firmly mounted on the shaft 7 for rotation therewith, whereas the winding drum 4, which is rotatably supported has a certain rotational freedom, however under the control of the torsion spring 6. The torsion spring 6 accommodates the changing speed of the winding drum or tube 4 which is caused by the changing diameter of the blind wound from, or onto, the winding tube 4 while the pull rod 8 moves at a uniform speed. When the blind is fully unwound from the winding tube 4, the diameter of the winding tube 4 is the smallest; when the blind is fully wound onto the winding tube the diameter is the largest. The rotation speed of the winding tube therefore is not synchronous with the movement of the pull rod 8.

Figure 4:
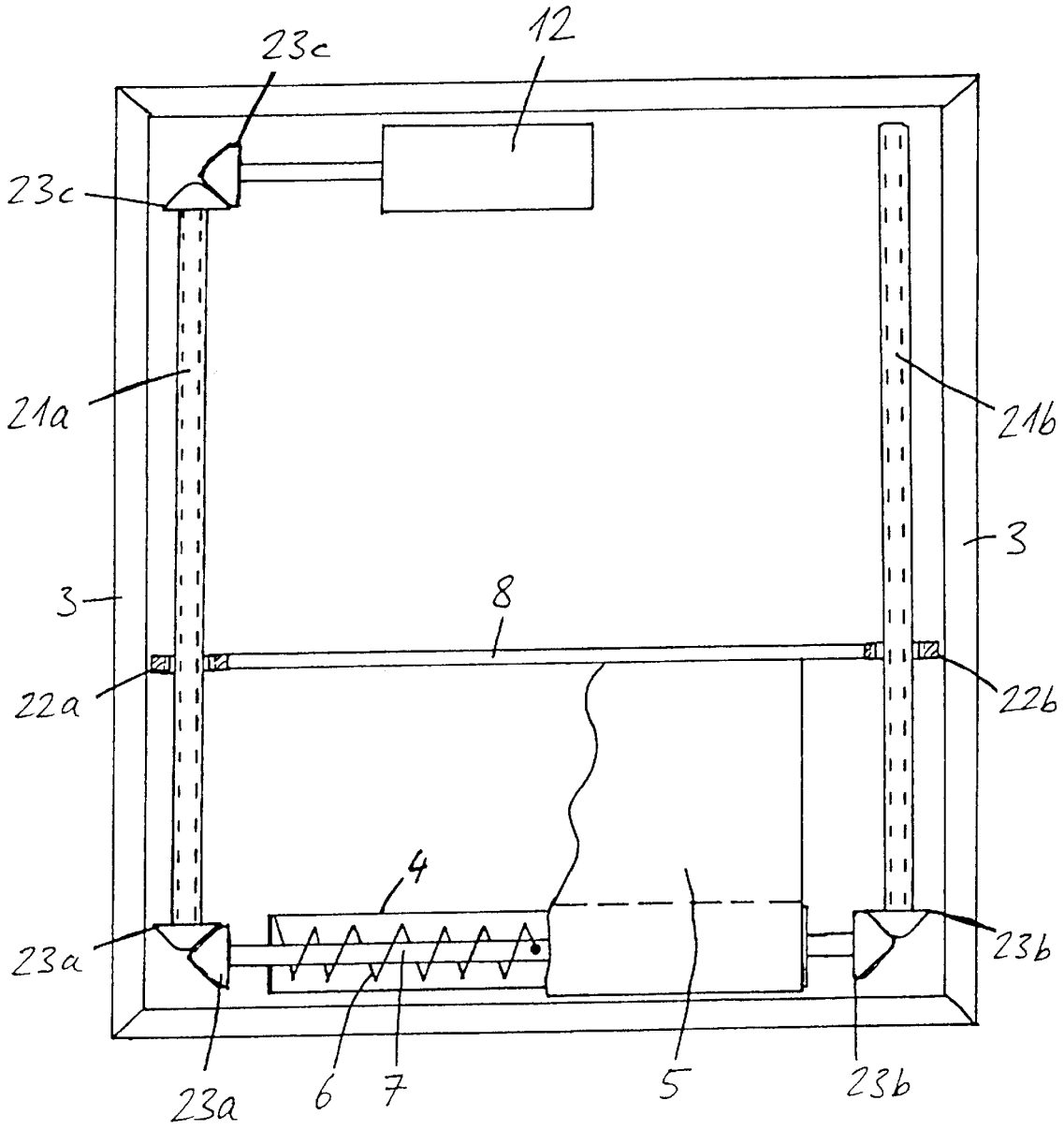
FIG. 4 shows an arrangement similar to that shown in FIG. 1, wherein the roller blind device, however, is provided with a different drive mechanism.

FIG. 4 shows another embodiment of the roller blind device according to invention wherein the mechanism for moving the pull rod 8 is different. As in the embodiment shown in FIGS. 1 to 3, the roller blind device arranged between the two glass panels 1, 2 includes a drum 4 on which the blind 5 (foil) is mounted by cementing and onto which it is wound. Again, the drum 4 is connected to the shaft 7 by a pre-tensioned torsion spring 6. The free front end of the blind is again connected to a pull rod 8.

Instead of the toothed belts, however, used in the embodiment shown in FIGS. 1 to 3, the embodiment as shown in FIG. 4 uses two threaded spindles 21*a* and 21*b* for moving the pull rod 8. The pull rod 8 carries two threaded units 22*a*, 22*b*, which are threaded onto the spindles 21*a*, 21*b*. The bearings for the spindles 21*a* and 21*b* are not shown for simplicity reasons.

The drive connection between the two threaded spindles 21*a* and 21*b* and the shaft 7, which carries the drum 4 is established by bevel gear drives 23*a* and 23*b*. In accordance therewith the electric motor 12 is operatively connected to the threaded spindle 21*a* (or 21*b*) by way of a bevel gear drive 23*c*. Of course, the shaft of the electric motor may extend across and may be coupled with the other threaded spindle 21*b* by a corresponding beveled gear drive.

The embodiment of FIG. 4 has the advantage that no tension devices are required which are needed for the embodiment with toothed belts as shown in FIGS. 1–3. Also, the spindles can be easily accommodated in the space between the glass panels 1 and 2.

What is claimed is:

1. An insulating glass window with an integrated roller blind device, comprising two spaced glass panels hermetically sealed around the circumference thereof to provide a sealed space therebetween, in which said roller blind device is enclosed, said roller blind device comprising, within said sealed space, a wind-up drum supported on a rotatable shaft supported at one end of said sealed space, a blind connected with one end to, and being wound onto, said drum, the other, free, end of said blind being connected to a pull rod, a pull member arranged within and along each side of said sealed space at opposite ends of said drum and being operatively connected to said rotatable shaft for synchronous movement, said pull rod being connected at its opposite ends to said pull members, and an electric motor operatively connected to said shaft for rotating said shaft and, at the same time, moving said pull rod or unwinding said blind from, or winding it onto, said drum.

2. An insulating glass window according to claim 1, wherein said wind-up drum is tubular and is rotatably supported relative to said shaft and a torsion spring is disposed within said drum and connected to said shaft so as to provide for a rotationally resilient connection therebetween.

3. An insulating glass window according to claim 1, wherein said pull members are toothed belts and said shaft includes, at opposite ends, toothed belt pulleys, and guide pulleys are disposed in spaced relationship of the pulleys mounted on said shaft, said toothed belts extending over said spaced pulleys along opposite ends of said sealed space, said pull rod being connected to said toothed belts for movement therewith.

4. An insulating glass window according to claim 3, wherein said electric motor is connected to at least one of said guide pulleys, said at least one guide pulley being a toothed belt pulley.

5. An insulating glass window according to claim 3, wherein said guide pulleys are supported, each on a tensioning unit, which is spring-biased away from said shaft for tensioning said toothed belts.

6. An insulating glass window according to claim 3, wherein said shaft is supported at opposite axial ends by ball bearings.

7. An insulating glass window according to claim 1, wherein said pull members are threaded spindles and the opposite ends of said pull rod is provided with threaded spindle units engaged by said threaded spindles for moving said pull rod upon rotation of said spindles, said spindles being connected to said rotatable shaft by gear drives.

8. An insulating glass window according to claim 7, wherein said electric motor is operatively connected to at least one of said threaded spindles by way of a gear drive disposed at the end of said threaded spindle remote from said shaft.

9. An insulating glass window according to claim 7, wherein said gear drives are bevel gear drives.

10. An insulating glass window according to claim 1, wherein said blind is one of a sun protection and a darkening blind.

11. A roller blind device for installation into a space formed between two spaced glass panels of an insulating glass pane, said roller blind device comprising a wind-up drum supported on a rotatable shaft having toothed belt pulleys at its opposite axial ends, a blind connected with one end to, and being wound onto, said drum, the other, free, end of said blind being connected to a pull rod, toothed belts arranged as pull members at opposite axial ends of said drum and extending therefrom rectangularly and in parallel spaced relationship, said toothed belts being operatively engaged with said toothed belt pulleys of said rotatable shaft for synchronous movement, said pull rod being connected at its opposite ends to said toothed belts, an electric motor operatively connected to said shaft for rotating said shaft and said pulleys and, at the same time, moving said pull rod for unwinding said blind from, or winding it onto, said drum and guide pulleys disposed in spaced relationship of the pulleys mounted on said shaft, said guide pulleys being supported each on a tensioning unit, which is spring-biased away from said shaft for tensioning said toothed belts.

12. A roller blind device according to claim 11, wherein said wind up drum is tubular and is rotatably supported relative to said shaft and a torsion spring is disposed within said drum and connected to said shaft, so as to prove for a rotationally resilient connection therebetween.

13. A roller blind device according to claim 11, wherein said electric motor is connected to at least one of said guide pulleys, said at least one guide pulley being a toothed belt pulley.

14. A roller blind device according to claim 11, wherein said shaft is supported at opposite axial ends art ball bearings.

15. A roller blind device according to claim 11, wherein said blind is one of a sun protection and a darkening blind.

* * * * *